US006033295A

United States Patent [19]

Fisher et al.

[11] Patent Number: 6,033,295

[45] Date of Patent: Mar. 7, 2000

[54] SEGMENTED CUTTING TOOLS

[75] Inventors: Kawika Shawn Fisher, Buford; Steve Allen Moon, Loganville, both of Ga.

[73] Assignee: Norton Company, Worcester, Mass.

[21] Appl. No.: 08/933,791

[22] Filed: Sep. 19, 1997

Related U.S. Application Data

[63] Continuation of application No. 08/365,274, Dec. 28, 1994, abandoned.

[51] Int. Cl.[7] ..... B24D 5/06; B24D 7/06

[52] U.S. Cl. ..... 451/540; 451/542; 451/548; 125/15

[58] Field of Search ..... 451/540, 542, 451/546, 548; 125/15; 76/108.4, 108.2, 112

[56] References Cited

U.S. PATENT DOCUMENTS

| | | | |
|---|---|---|---|
| 3,028,710 | 4/1962 | Pratt | 51/206 |
| 3,049,843 | 8/1962 | Christensen | 51/206 |
| 3,128,755 | 4/1964 | Benson | 125/15 |
| 3,513,821 | 5/1970 | Bouvier | 125/15 |
| 4,860,722 | 8/1989 | Veglio | 125/15 |
| 4,883,500 | 11/1989 | Deskins et al. | 51/298 |
| 5,443,418 | 8/1995 | Frodin et al. | 451/540 |
| 5,518,443 | 5/1996 | Fisher | 451/540 |

FOREIGN PATENT DOCUMENTS

| | | | |
|---|---|---|---|
| 2318378 | 9/1974 | Germany | 125/15 |
| 2346092 | 3/1975 | Germany | B23D 61/00 |
| 2510298 | 9/1976 | Germany | E21C 13/06 |
| 3347501A1 | 9/1985 | Germany | B22F 7/06 |
| 57-033969 | 2/1982 | Japan | B24D 5/12 |
| 57-83372 | 5/1982 | Japan | B24D 5/14 |
| 7083372 | 5/1982 | Japan | 451/544 |
| 57-184674 | 11/1982 | Japan | B24D 5/12 |
| 59-69268 | 4/1984 | Japan | B24D 5/12 |
| 61-293770 | 12/1986 | Japan | B24D 5/12 |
| 2032500C1 | 4/1995 | Russian Federation . | |
| 329025 | 4/1972 | U.S.S.R. | B28D 1/12 |
| 2232619A | 12/1990 | United Kingdom | B23B 51/04 |
| 2001542 | 2/1992 | WIPO | 83/651 |
| 9201542 | 2/1992 | WIPO | B28D 1/12 |

*Primary Examiner*—Robert A. Rose
*Attorney, Agent, or Firm*—Mary E. Porter

[57] ABSTRACT

Segmented cutting tools such core drill bits and diamond saw blades can be made more efficient by hardening a portion of the sides of each of the segments.

9 Claims, 3 Drawing Sheets

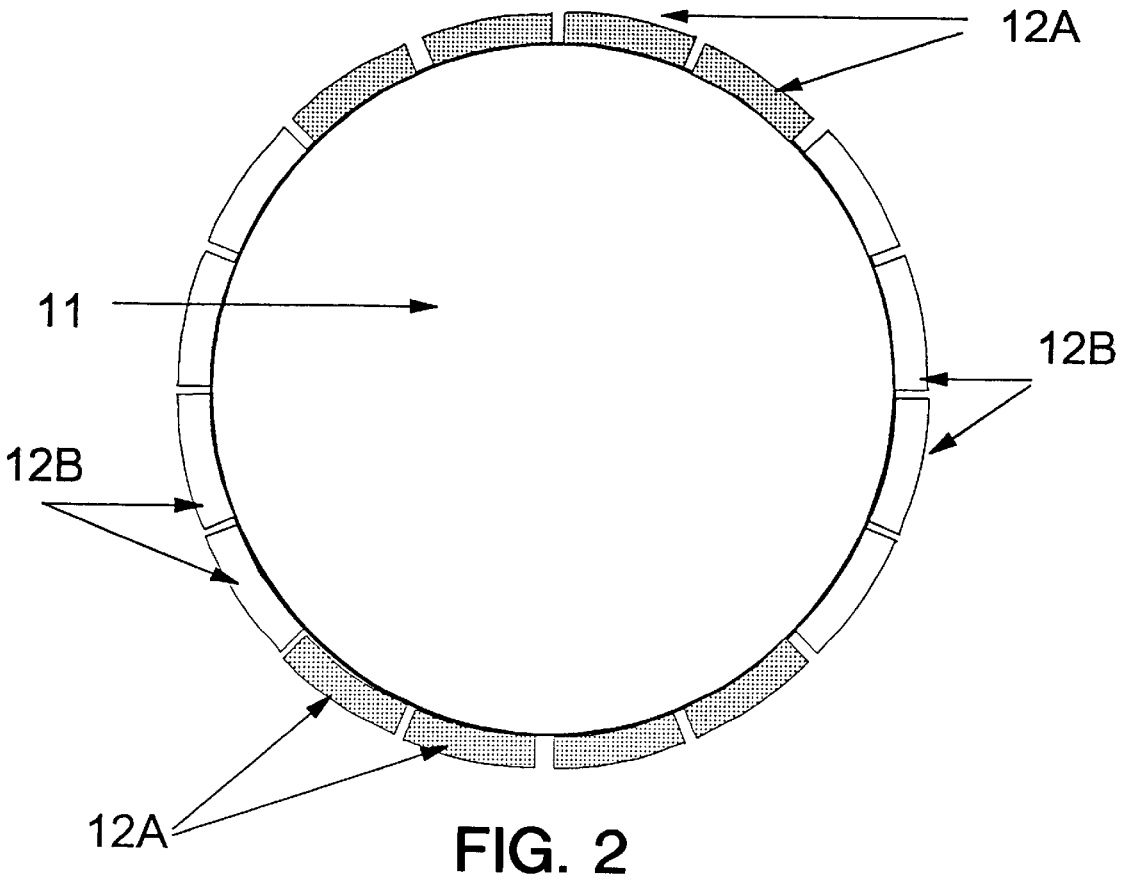
FIG. 2
FIG. 3
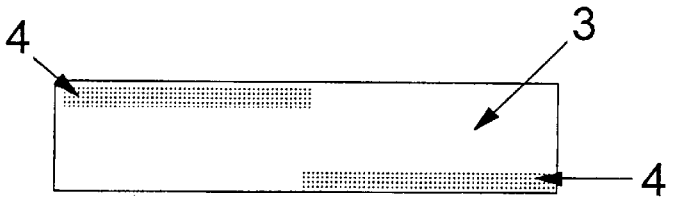

SEGMENTED CUTTING TOOLS

This application is a continuation of application Ser. No. 08/365,274, filed Dec. 28, 1994, now abandoned.

BACKGROUND TO THE INVENTION

This invention relates to segmental cutting tools. Such tools comprise a body member and, affixed to the body member, a plurality of segments comprising the abrasive components that perform the cutting. The most common cutting tools to which this invention relates are core bits, diamond saw blades and segmented wheels. The present invention is applicable to all such tools in which the cutting action is performed by segments attached to a body member.

Core bits are used to drill holes in very hard materials such as rock strata or concrete members. The bit comprises a cylindrical steel body member adapted at one end for attachment to a drill and having a plurality of spaced segments located around the annular rim at the opposed end of the cylinder that perform the cutting function.

Segmented wheels and diamond saw blades comprise a metal disc with a plurality of segments fixed to and spaced around the circumference of the disc to provide the cutting means.

The segments comprise abrasive particles dispersed in a metal bond and these segments are most frequently attached by being welded to the body member. The segments usually have a basically rectangular configuration with one long edge being welded to the body member. In a core bit the "rectangular segment" is bowed along its length to allow the long edge to conform to the annular edge of the cylindrical body member to which it is attached. Thus the segments project from the body member by the amount of their width. The thickness of the segments is conventionally the same as, or a little greater than, the thickness of the edge of the body member to which they are attached.

In a segmented wheel or diamond saw the rectangular segments are also bowed but in this case the are bowed in such a way as to conform a long edge of the segments to the curvature of the rim of the disc to which it is to be attached.

The number of segments and their spacing around the edge of the body member to which they are attached can vary somewhat depending on the size of the body member and the application. In general however, for core drill bits having a diameter of from about 50 mm to 500 cm, from about 2 up to several hundred segments may be used. Smaller or larger diameter drill bits may use fewer or more respectively. Segmented wheels can have from about 8 up to several hundred segments depending on the diameter of the wheel. Such wheels are generally from about 10 cm and up in diameter.

The abrasive component can be any one of those commonly used for such applications, the grit being chosen depending on the hardness of the material to be cut. Thus the grain may be aluminum oxide, silicon carbide, tungsten carbide or a superabrasive such as diamond or cubic boron nitride, (CBN). Superabrasives are usually preferred though the superabrasive component may be diluted with less expensive abrasive grits. The abrasive is typically held in a metal bond and the adhesion to the bond may be enhanced by metal coating the grain with a metal such as nickel, before it is incorporated in the segment.

One of the problems with core bits is in ensuring that the outside gauge of the hole drilled remains constant. This is because the edges of the segments tend to wear away more quickly than the central portion of the segments making the cutting operation slower and less efficient. This can lead to widening of the outer gauge of the hole being drilled and, where there are variations in the hardness of the material being drilled, this too can lead to deviations from the desired direction of drilling.

This problem has typically been addressed by forming the segments with a higher concentration of abrasive along both of the sides of the segment making the segment harder along the outer surfaces. These are often called "sandwich segments". The difference in hardness creates a profile on the surface being cut that provides self-centering of the bit. However this solution is only partially effective because the resultant cut rate is often significantly slowed or the tool life is significantly reduced. It has now been found possible to greatly improve the efficiency of cutting in a surprising and unobvious way using the novel tool design that is the subject matter of this invention. Not only does the design provide faster cutting but in some embodiments it appears to provide longer life and/or an efficient self-centering mechanism that ensures the hole drilled remains straight.

GENERAL DESCRIPTION OF THE INVENTION

The present invention comprises a cutting tool comprising a body member having attached thereto a plurality of segments each having first and second parallel outer surfaces perpendicular to the surface presented to the workpiece during cutting, said segments being fixed at intervals to a perimeter edge of the tool to provide a cutting means wherein a portion of the parallel outer surfaces of the segments is hardened while some portions of the surfaces of the segments remain unhardened. The segments are preferably located upon the body member such that, viewed from either side of the body member, the segments present a sequence of hardened and unhardened surfaces around the circumference of the body member. This may be because all of one side of a segment is hardened and after each such segment or group of such segments, a segment or group of segments presenting unhardened surfaces. Alternatively all the sides of the segments can be provided with stripes of hardened and unhardened surfaces areas that are preferably substantially perpendicular to the length of the segment. The number of stripes on each side may be one or more of each, (hardened and unhardened).

In a simple form of the cutting tool of the invention a whole side of about half of the segments around the periphery of the cutting tool are hardened on one surface and the other half are hardened on the opposed surface such that, viewed from either side of the tool, half the sides are hardened and half are unhardened. The hardened sides may alternate with unhardened or they may appear in groups.

When explaining the invention with reference to the one-side-hardened segments these will be referred to hereafter as either "inside" or "outside" (-hardened) segments, depending on whether the hardened side is on the inside or the outside of the drill core bit. Transposed to the context of a segmented wheel "inside" and "outside" are understood to refer to the segment surfaces exposed on a first side of the wheel and the opposite side of the wheel respectively. This is for the sake of simplicity and is not to be taken as inferring that the invention is limited to such structures or even a preference for them.

The segments having this pattern of hardening are attached to a drill core bit and can be alternated with each inside segment being between two outside segments but more frequently it is desirable to group the segments such that there are four or five (for example) inside segments followed by a similar number of outside segments in sequence around the cutting surface of the drill core bit. The number of segments in each grouping is not however critical to the practice of the invention but a preferred arrangement is one in which about half the circumference has inside segments and the remainder of the circumference has outside segments. It is also possible to intersperse some segments in which neither side is hardened without departing from the spirit of the invention.

Where the cutting tool has segments with "inside" and segments with "outside" hardening, the numbers of each kind of segment around the edge of the cutting tool are preferably about equal and it is understood that this permits odd numbers of segments fixed to the body member such that the number of one type exceeds by one the number of the other type, or even numbers of segments with the number of one type exceeding the number of the other type by two. Equally if only parts of the segment surfaces are hardened, the total segment surface area around the wheel that is hardened is preferably about the same as the total segment area that is unhardened. However it should be understood that tools in which all the hardened portions of the sides are either inside surfaces or, more preferably, outer surfaces, are within the scope of the present invention.

DETAILED DESCRIPTION OF THE INVENTION

As indicated above the segments described above are useful in drill core bits and also in diamond saw blades and other segmented cutting wheels. The only difference lies in the configuration and orientation of the segments upon the body member because the attached edge of the segment needs to conform to the curvature of the circumference of the body member to which it is attached. The same preferred pattern of alternating hardened sides or portions of sides with segments having the same side or portion of a side unhardened and appearing singly and alternately or in groups around the circumference of the wheel may be used in such tools.

Instead of alternating hardened sides (singly or in groups), it is possible to have the alternation occur more frequently by having only a portion, for example one half, of a side hardened on each side of the segment. In such an arrangement it is often preferred to provide that the segment surface be divided such that one end is hardened and the other end is not and that the pattern be reversed on the opposite surface of the segment. This arrangement is illustrated in FIGS. 3 and 4C of the drawings. Alternatively the hardened parts can be in stripes as illustrated in FIGS. 4F and 4G.

The hardening stiffens the surface and causes that part of the segment to cut more freely during use. For some reason that is not fully understood, this often causes the bit to be self-aligning, more of the cutting energy being directed to the cutting surfaces and not lost to drag on the sides of the hole being drilled. In addition the cutting surface area at any given moment is reduced giving a higher force per unit area and hence freer and faster cutting.

The surface may be hardened by providing that the segment has a higher concentration of abrasive grit in the region of the hardened surface. Segments are usually molded from a mixture of the abrasive grit and a powder of the metal that will provide the bond. This mixture is heated either in situ in the mold or just prior to loading the mixture into the mold. A typical mold comprises a barrel and two ram members that are urged together when the mold is closed to form the sides of the segment. Where the segment is intended for a core drill bit, the ram surfaces are curved to correspond to the desired degree of curvature for the segment to fit on the circumference of the body member. Hardening of one side can readily be achieved by placing a layer of abrasive grit in the mold, for example on the surface of one of the ram members before the addition of the metal/grit mixture. Alternatively a further amount of abrasive grit could be brazed or otherwise fixed to the surface that is to be hardened after the segment has been formed. The hardening may be achieved by the use of a grit that is different from the grit(s) in the body of the segment. In this connection the use of ceramic alumina grits is particularly advantageous because of the inherent hardness of such grits. Ceramic alumina filamentary grits are found to be particularly effective in the hardening of segment surfaces.

Where the segment comprises more than one grit the hardening can be achieved by surface hardening using only one of the grits. Since one is usually a diluent grit the one selected is preferably the diluent since that is presumably cheaper. Thus for example a segment in which a superabrasive is mixed with a ceramic alumina grit, whether in the form of filamentary abrasive particles or particles with random crushed shapes, the grit used by preference to harden the surface is the alumina grit. In the case of such mixtures it is sufficient to increase the concentration of the diluent grit adjacent the surface to be hardened, or to apply a-coating of such grits to the surface as described above.

Hardening using an abrasive grit is preferably done using a ceramic alumina such as is described in number of patents describing the production of sol-gel alumina abrasive grits including U.S. Pat. Nos. 4,623,364; 4,744,802; 4,788,167; and 4,881,971. Particularly preferred are the sol-gel alumina filamentary abrasive particles described in U.S. Pat. Nos. 5,194,072; and 5,201,916.

A further hardening technique can be to eliminate at least a significant proportion of the abrasive from a portion of the segment providing the surface that is intended to be unhardened relative to the hardened surface. Such an approach is illustrated in FIG. 4D for example. Such segments can be-made by forming the segment in a two-charge process with the composition of the first charge having more or less abrasive content than that of the second charge going into the mold.

Segments can also be hardened along one surface by the use of a harder bond material at that surface. Care must be taken however to ensure that the segment does not show reduced structural integrity as a result of such compositional variations. In addition a surface can be "softened" such that the un-softened sides are harder by comparison.

DRAWINGS

FIG. 2 shows a perspective view of a segmented blade with the hardening of the segments shown as in FIG. 1.

FIG. 3 illustrates a cross-sectional view taken parallel to the cutting surface of a segment for a segmented wheel with opposite ends of each side hardened using a coating of abrasive grit.

FIGS. 4A through 4H illustrate the various segment designs that can be used in the practice of the invention, with the segment illustrated being shown in simplified form as a rectangular block. In each case a shaded portion indicates an area of greater abrasive concentration than appears in an unshaded portion, (which might represent a concentration as low as zero). This would of course result in surfaces of greater hardness for the surfaces of such shaded portions. Stippled surfaces are those that have been hardened by a surface treatment such as by having a layer of abrasive particles deposited thereon and therefore have a greater hardness than the plain surfaces.

DESCRIPTION OF PREFERRED EMBODIMENTS

The invention is now described with reference to the following Examples which are for the purpose of illustration only and are intended to imply no essential limitation on the scope of the invention.

EXAMPLE 1

In this Example a drill core bit was prepared using segments made and placed according to the invention. This bit was compared with a drill core bit of exactly the same design except that the segments were not hardened along one side. The performance of the two bits was compared in side-by side-testing.

In each case the bond used was a 70/30 wt % blend of cobalt/bronze and the abrasive grit was 30/40 mesh diamond from DeBeers with a grade of SDA 100+. The amount of diamond in the segments was set at 10 vol %. Segments made from this bond/grit mixture had a 3 mm kerf and a 24 mm length. Nine such segments were brazed to a body member to provide a conventional 10.1 cm diameter core drill bit.

Figure 4A:
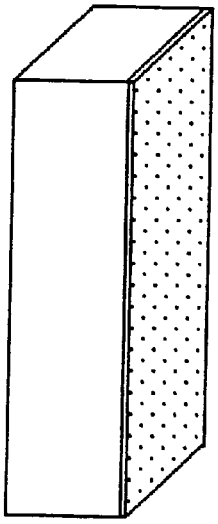
Figure 4B:
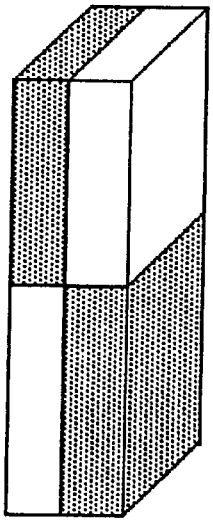
Figure 4C:
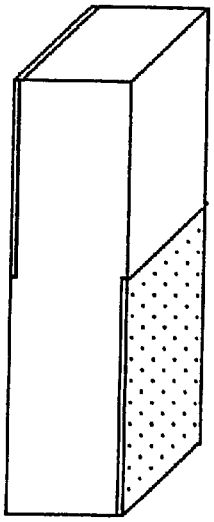
Figure 4D:
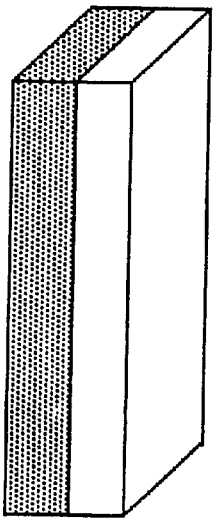
Figure 4E:
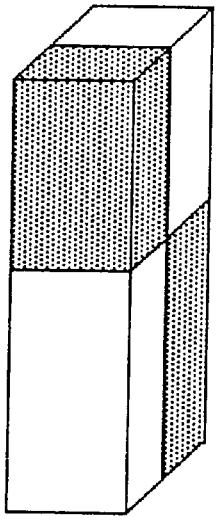
Figure 4F:
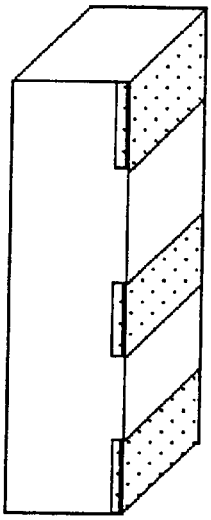

A similar accordance with (with modified segments in accordance with the invention), was made by brazing modified segments to the same type of body member. The modified segments were made by placing a thin layer of 36 grit seeded sol-gel alumina filamentary abrasive particles on one surface of the mold used to cast the segments before the same bond/diamond grit described above was added. The abrasive was applied in stripes as illustrated in FIG. 4F of the drawings. Inside and outside segments were made in this way.

The segments were cast with the alumina coating on inside surfaces for four segments and on the outside surface for five of the segments, making nine segments in all. These nine segments were brazed to an identical body member to that used to produce the conventional bit described above. The inside coated segments were located sequentially around the perimeter of the body member with the outside coated segments following, also sequentially. The configuration was essentially as described in FIG. 1. In that drawing a body member, 1, has welded to it nine segments, 2, at equally spaced intervals around the end of the body member to provide the cutting surface. Five of the segments, marked 2A, were stripe-hardened on the outside and four, marked 2B, were stripe-hardened on the inside.

The two core drill bits were then used to drill holes in Georgia granite cured concrete with one 1.6 cm steel reinforcing bar in each hole. The drill used was a "Clipper" (registered trademark of Norton Company) two speed drill operating at 900 rpm and drawing 20 amps. The reinforcement bar was cut completely through in each hole. Eighty 10 cm-deep holes were cut with each bit and every fifth hole was timed and the overall average speed of cut, (in cm/minute), was determined. The amount of wear of the segments as a result of the boring was determined, (in meters cut per mm of wear). The results were as follows:

| | Penetration Rate | Wear Performance |
|---|---|---|
| Control | 6.1 cm/min | 2.8 M/mm |
| Invention | 9.0 cm/min | 5.64 M/mm |

Thus the bit according to the invention had a 96% improvement in life and a 48% improvement in penetration rate over the conventional bit.

EXAMPLE 2

This Example shows the advantage of the invention when applied to a segmented wheel rather than a core drill bit as used in Example 1.

Such a segmented wheel is illustrated in FIG. 2 which shows a body member, 11, in the form of a metal disc with, laser welded to the circumference of the wheel, a plurality of spaced segments, 12, which had each been hardened on one surface using a coating of abrasive grits exactly as described in Example 1. The hardened surfaces are arranged in groups such that four consecutive segments have the hardened surface facing the viewer, marked 12A, coated and the next four, marked 12B, have the hardened surface on the opposite side from the viewer coated, and so on around the circumference of the wheel.

The wheel actually used in this Example 2 however had the coatings arranged somewhat differently. Each segment had half of each side coated such that on one side the left hand half was coated while on the other side, the opposite end was coated. This resulted in segments having a cross-section as shown in FIG. 3. The cross section is taken through the body of the segment and parallel to the tangent to the cutting surface. The segment, 3, has a coating, 4, on opposed sides at opposed ends of the segment.

The wheels used in this Example 2 were 35.6 mm wheels. Each had 21 segments brazed to the body member and, within each wheel, each segment was identical. In each wheel the bond was a 70/30 cobalt/bronze mixture and the diamond used was an equal parts mixture of 30/40 and 40/50 mesh DeBeers SDA 85+ diamond in a concentration of 7.5 vol %. Each segment had a length of 49.2 mm and a kerf of 3.2 mm.

The control wheel had no hardening of any of the surfaces. The wheel according to the invention had segments modified as described above in the discussion of FIG. 3. The hardening was provided by coated half of the hardened surface with the same seeded sol-gel filamentary alumina abrasive grit as was used in Example 1 for the same purpose.

The two wheels were then used to cut a 7.62 cm slot for a length of 5 feet in rose quartz cured concrete. A closed loop controller maintained the power drawn down at a constant 15 kilowatts. This of course resulted in variation in the speed of cut. The wheel was rotated at 2400 rpm.

The results are reported as speed of cut, (in cm/min), and wear performance which is defined as the total cross-sectional area of the cut divided by the radial wear and is reported as square meters (of area cut) per millimeter (of wear).

| | Speed of Cut (cm/min) | Wear Performance ($M^2$/mm) |
|---|---|---|
| Control | 105 | 6.62 |
| Invention | 107 | 7.75 |

Thus the wheel according to the invention had essentially the same speed of cut and a 17.1% longer life.

EXAMPLE 3

In this Example a drill core bit according to the invention is compared with a standard drill core bit. The standard (control) drill bit had superabrasive uniformly distributed throughout the segment and no surface was hardened. The drill core bit according to the invention had all the outside surfaces of the segments hardened using the ceramic alumina abrasive grain used in Example 1.

In each case the bond was 100% bronze, the diamond was 35/40 mesh DeBeers SDA 100+ grade and represented 8.75% of the volume of the segment. The segments had a 4 mm kerf and were 24 mm long. Nine segments were located around the periphery of the 10.1 cm diameter core bit body member.

For each blade a total of 20 cuts were made to a depth of 250 mm in a medium hard cured concrete (5,000 psi) with three 16 mm rebars. Each cut cut through all three rebars. The drill used was a Milwaukee 2.2 KW drill drawing 11 amps and rotating at 600 rpm. The results obtained were as follows:

| | Penetration Rate | Wear Performance |
|---|---|---|
| Control | 6.0 cm/min | 1.59 meters/mm |
| Invention | 5.9 cm/min | 2.48 meters/mm |

As can be seen the test bit according to the invention had a 56% improvement in life with no change in the penetration rate.

EXAMPLE 4

In this Example the comparison refers to diamond saw blades. The blades were 35.6 cm diameter blades with a total of 21 segments spaced around the periphery of the body member.

The standard, (control) blade had superabrasive grits (diamond) randomly distributed throughout the segments all of which were identical. The saw blade according to the invention had the diamond grits located within only half the thickness of the segments as illustrated in FIG. 4D. The segments were alternated around the periphery of the body member such that each hardened side was located between two unhardened sides, and vice versa.

The bond used was a 70/30 blend of cobalt and bronze and the diamond used was an equal parts mixture of 30/40 mesh and 40/50 mesh DeBeers SDA 85+ grade diamond. The diamond provided 7.5% of the segment volume. Each segment had a 3.2 mm kerf and a length of 49 mm. Each blade was used to cut rose quartz cured concrete. Cuts 7.62 cm deep and 152.4 cm long were cut with each blade at three different power output levels. An automated test saw operating at 2400 rpm was used. Control of the power level resulted in a variation of the speed of the cuts. The results are set forth in Table 1 below.

TABLE 1

| | POWER | CONTROL | INVENTION |
|---|---|---|---|
| CUT SPEED (cm/min) | 10 KW | 68 | 79 |
| WEAR PERF. ($M^2$/mm) | 10 KW | 11.39 | 6.76 |
| CUT SPEED (cm/min) | 15 KW | 105 | 142 |
| WEAR PERF. ($M^2$/mm) | 15 KW | 6.62 | 3.24 |
| CUT SPEED (cm/min) | 20 KW | 178 | 196 |
| WEAR PERF. ($M^2$/mm) | 20 KW | 1.07 | 0.74 |

Thus the blade according to the invention has a higher speed of cut at each power level and as the power increases, the difference in wear performance becomes smaller.

EXAMPLE 5

Figure 4G:
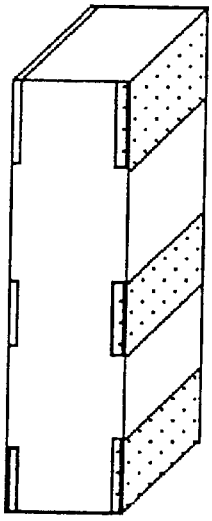
Figure 4H:
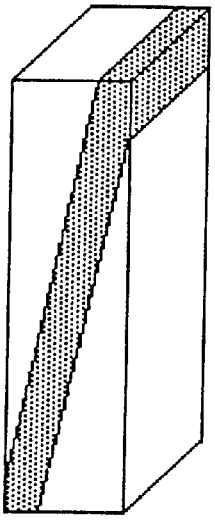

This Example shows the increased life that results from the selective hardening of the segment sides in a drill core bit where the hardening pattern is as shown in FIG. 4G.

Two 10.2 cm diameter core drill bits were made with identical numbers and types of segments save for the selective hardening of portions of the sides of the segments of one of the drill bits designated as "Invention". The other drill bit was designated "Control".

Each segment comprised a cobalt/bronze, (80/20 proportions), and 30/40 mesh DeBeers SDA 100+ quality diamond in an amount sufficient to provide 10 vol % of the segment. Each segment had a length of 24 mm and a kerf of 3 mm. Each core bit had nine segments. The segments in the core drill bit according to the invention were hardened in three stripes on each side running perpendicular to the segment length in the manner described in FIG. 4G. Hardening was achieved by application to each side of each segment stripes of a seeded sol-gel alumina filamentary abrasive grit with a grit size of 36.

The bits were used to cut 80 cuts with the first 40 considered as "break-in" for the bits. The performance over only the last forty cuts was measured. Every fifth cut in the last 40 was timed and the overall speed of cut, (or Penetration Rate), was determined. A measuring device was used to assess the difference in height of the segments before and after cutting to permit assessment of the Wear Performance.

Each cut was four inches deep and was cut in Georgia granite cured concrete with one 15.9 mm diameter rebar cut in each hole. The drill was a "Clipper" two speed drill operating at 900 rpm and drawing 20 amps.

The results obtained were as follows:

| | Penetration Rate | Wear Performance |
|---|---|---|
| Control | 7.44 cm/min | 11.87 meters/mm |
| Invention | 6.51 cm/min | 22.93 meters/mm |

Thus the Invention bit had a 93% improvement in its life with only a 12.5% decrease in its penetration rate by comparison with the Control bit.

It is therefore clear that by selectively hardening part of all of the sides of some of the segments in drill core bit or segmented saw blade, significant advantage can be derived in terms of efficiency of performance and durability of the tool.

EXAMPLE 6

Figure 1:
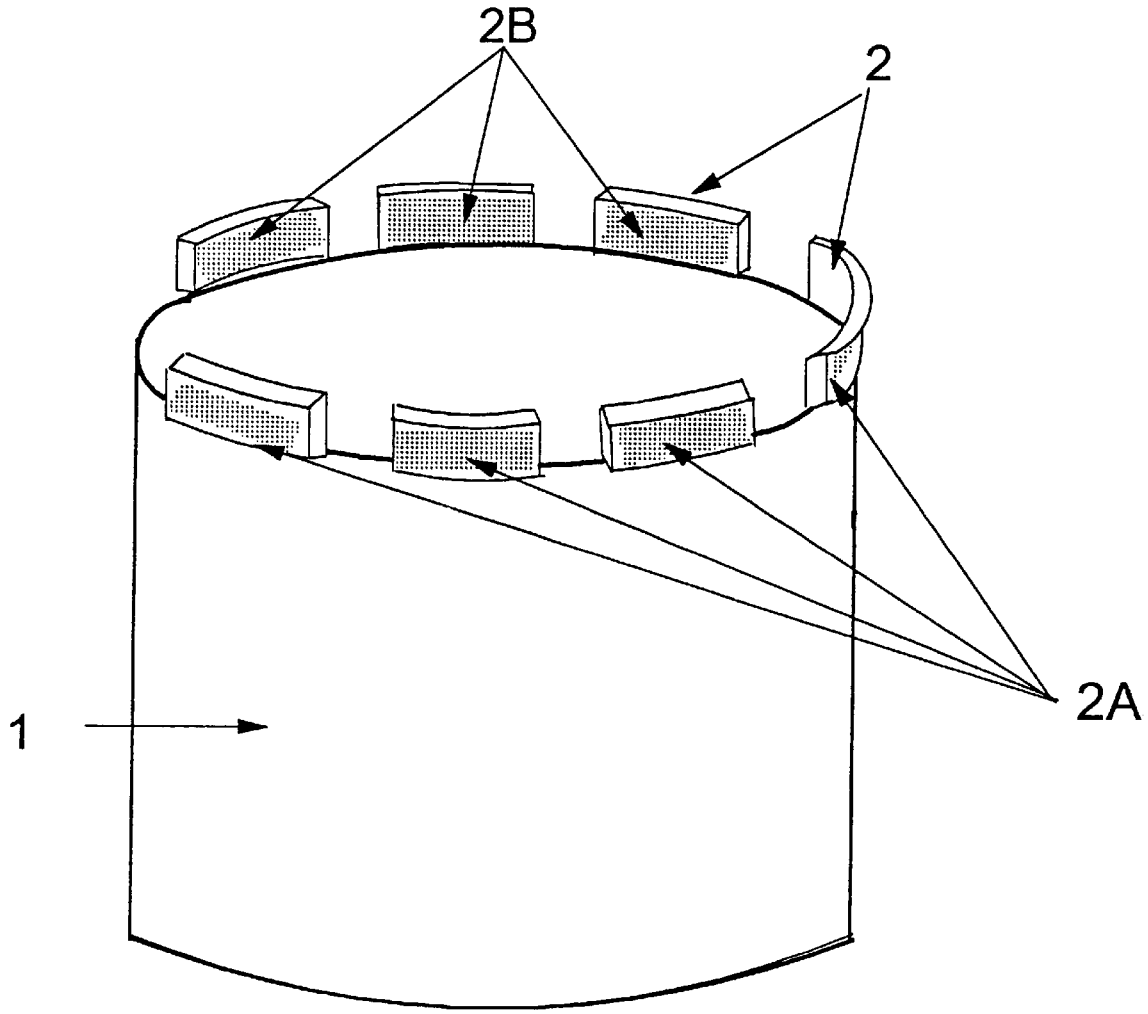
FIG. 1 shows a perspective view of a core drill bit comprising a plurality of segments. The increased concentration of abrasive is shown schematically by a shading along the hardened surface.

In this Example two 10.2 cm diameter drill core bits were evaluated side by side. Each was configured according to the design shown in FIG. 1 except that in one the segments were unhardened in any way and in the other the segments were hardened along one side, (inside or outside), by placing 36 grit filamentary abrasive sol-gel alumina particles on the hardened surface, as illustrated in FIG. 4A. Segments were placed around the perimeter of the core drill bit with inside-hardened and outside-hardened sides grouped as shown in FIG. 1.

For each segment the bond used was a 70/30 vol % mix of copper and bronze and the abrasive dispersed throughout the segments was 30/40 mesh DeBeers SDA 100+ diamond in a 10 vol % concentration. Each segment had a kerf of 3 mm and a length of 24 mm. Nine segments were spaced around the perimeter of the drill core bit.

A "Milwaukee" drill drawing 8 amps of power and operating at 600 rpm was used to drill holes 30 cm deep in medium hard cured concrete with two 6.35 mm rebars in each hole. Every cut was timed and the overall speed of cut was determined. A measuring device was used to measure the height of the segments before and after.

The results obtained were as follows:

| | Distance Cut | Penetration Rate | Wear Performance |
|---|---|---|---|
| Control | 5.4 meters | 7.44 cm/min | 11.87 meters/mm |
| Invention | 0.9 meter | 6.51 cm/min | 22.93 meters/mm |

The bit according to the invention showed a 109% improvement in life with only a 2.3% decrease in penetration rate in comparison with the control bit.

What is claimed is:

1. A cutting tool having improved tool life, comprising a body member and affixed thereto in spaced relationship, a plurality of cutting segments together forming a cutting perimeter, each of said segments having a thickness, a length and first and second exposed parallel surfaces oriented perpendicular to the cutting perimeter and perpendicular to a workpiece during cutting, the segments being fixed at intervals to a perimeter edge of the tool to provide a cutting means, wherein at any given point along the cutting perimeter only one of the first and second exposed parallel surfaces is hardened, whereby areas of variable hardness exist across the thickness of each segment, non-hardened areas of the cutting perimeter wear at different rates during cutting than hardened areas, and along the length of each segment, less than the entire thickness comes into contact with the workpiece during cutting.

2. A cutting tool according to claim 1 in which the segments are located upon the body member such that both first and second sets of parallel outer surfaces present sequences around the peripheral edge of the tool of hardened and unhardened surfaces.

3. A cutting tool according to claim 1 in which each hardened surface or surface portion has an unhardened opposed parallel surface or surface portion on the same segment.

4. A cutting tool according to claim 1 in which segments having all of the same surface hardened are arranged sequentially in groups of from 1 to about 5 segments around the perimeter of the tool with a group of hardened surfaces alternating with a group of unhardened surfaces.

5. A cutting tool according to claim 1 in which the surfaces are hardened by a surface layer of abrasive particles.

6. A cutting tool according to claim 5 in which the surfaces are hardened using filamentary abrasive particles.

7. A cutting tool according to claim 1 in which both parallel outer surfaces of at least some of the segments are hardened in a plurality of stripes running perpendicular to the length of the segments.

8. A cutting tool according to claim 1 in the form of a drill core bit.

9. A cutting-tool according to claim 1 in the form of a segmented saw blade.

* * * * *